US007617933B2

(12) United States Patent
Bates et al.

(10) Patent No.: US 7,617,933 B2
(45) Date of Patent: Nov. 17, 2009

(54) PRODUCT DISPENSING AIDS

(75) Inventors: Aaron L. Bates, Powder Springs, GA (US); Erica L. Watson, Franklin, TN (US); Cynthia R. Parks, Atlanta, GA (US)

(73) Assignee: Meadwestvaco Packaging Systems, LLC, Glen Allen, VA (US)

( * ) Notice: Subject to any disclaimer, the term of this patent is extended or adjusted under 35 U.S.C. 154(b) by 600 days.

(21) Appl. No.: 11/419,425

(22) Filed: May 19, 2006

(65) Prior Publication Data

US 2006/0283723 A1 Dec. 21, 2006

Related U.S. Application Data

(60) Provisional application No. 60/683,455, filed on May 20, 2005.

(51) Int. Cl.
*B65D 65/00* (2006.01)

(52) U.S. Cl. ..... 206/427; 206/139; 229/122

(58) Field of Classification Search ..... 206/186, 206/427, 170, 139, 192, 254, 255, 153; 229/122, 229/125.125, 129.1, 220, 122.1
See application file for complete search history.

(56) References Cited

U.S. PATENT DOCUMENTS

| | | | | |
|---|---|---|---|---|
| 1,718,572 | A * | 6/1929 | Marcuse | 221/4 |
| 2,162,089 | A | 6/1939 | Kagen | |
| 2,415,117 | A | 2/1947 | Tamarin | |
| 2,946,621 | A * | 7/1960 | Williamson | 294/87.2 |
| 3,398,000 | A * | 8/1968 | Peters | 426/119 |
| 3,399,762 | A | 9/1968 | Potter | |
| 3,495,704 | A * | 2/1970 | Nelder, Jr. et al. | 206/196 |
| 3,858,762 | A | 1/1975 | Meshberg | |
| 3,900,104 | A * | 8/1975 | Harned | 206/784 |
| 4,109,826 | A * | 8/1978 | Maisonneuve | 221/72 |
| 4,709,811 | A * | 12/1987 | Shimada | 206/254 |
| 5,284,292 | A * | 2/1994 | Johnson | 229/122.1 |
| 5,368,194 | A | 11/1994 | Oliff et al. | |
| 5,439,111 | A | 8/1995 | Broskow et al. | |
| 5,518,111 | A | 5/1996 | Stout | |
| 5,687,847 | A | 11/1997 | Culpepper et al. | |
| 6,554,159 | B1 * | 4/2003 | Behr et al. | 221/305 |
| 6,676,013 | B2 * | 1/2004 | Auclair | 229/122 |
| 2004/0016795 | A1 | 1/2004 | Kanamori et al. | |
| 2006/0022025 | A1 * | 2/2006 | Beasley | 229/122.1 |
| 2006/0180488 | A1 * | 8/2006 | Spivey et al. | 206/427 |

FOREIGN PATENT DOCUMENTS

| | | |
|---|---|---|
| WO | WO 02/14166 A1 | 2/2002 |

* cited by examiner

*Primary Examiner*—David T Fidei
(74) *Attorney, Agent, or Firm*—Tsugihiko Suzuki

(57) ABSTRACT

Dispensing aids (100, 500, 1300, 2000) are provided to facilitate removing articles (B) from cartons (200, 600, 1500, 2100) having openings (O) that function as article dispensers. The dispensing aids (100, 500, 1300, 2000) engaging at least the articles (B) furthest from the opening (O) with means for engaging. The means for engaging includes an article engaging portion such as a top engaging collar (102), a bottom engaging sled (502), a side engaging crossbar (1310), or a belt (2002). The means for engaging is displaced toward the opening (O) of the carton by a means for displacing. The means for displacing may be a grip (104, 504, 1304, 2004) or strap (906). As the grip, strap, or other means for displacing the article engaging portion is pulled, the article engaging portion is drawn toward the opening (O) as are the articles that are engaged.

10 Claims, 8 Drawing Sheets

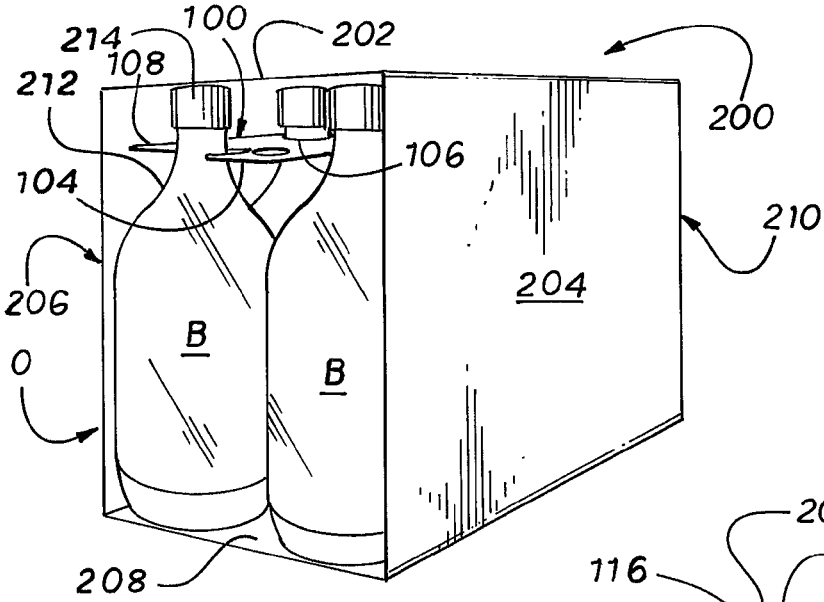
Fig. 2
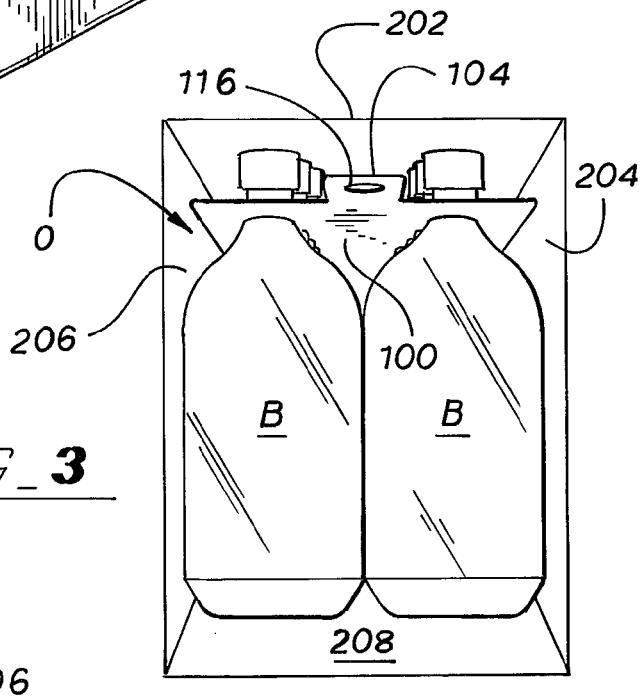
Fig. 3
Fig. 4
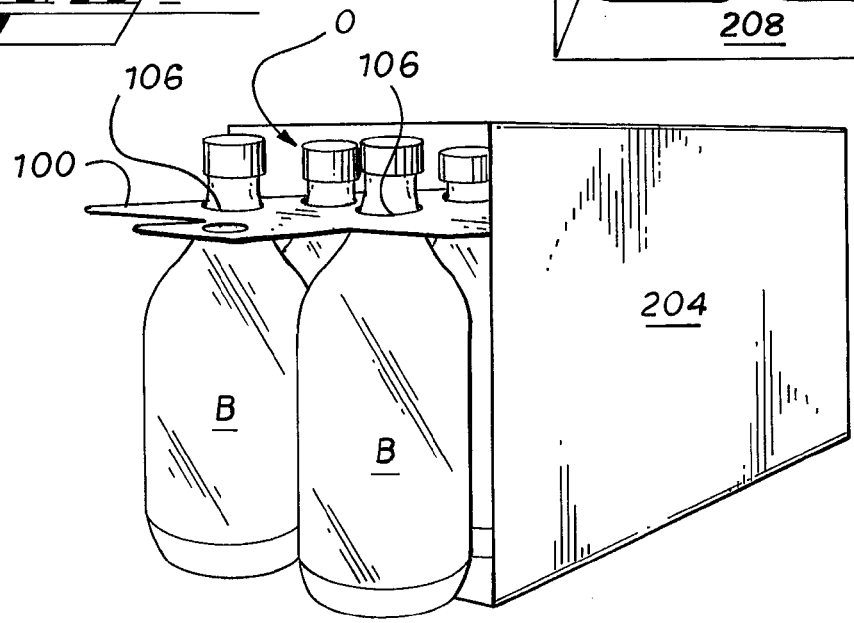

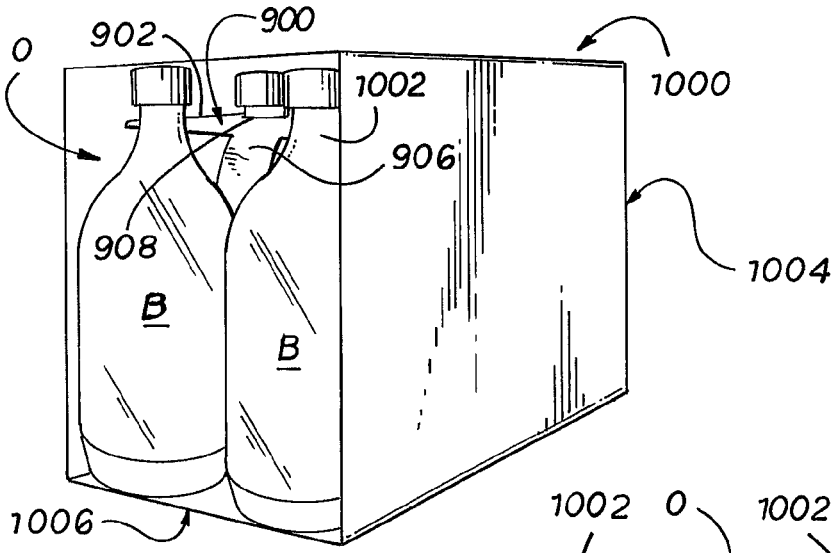
Fig_10
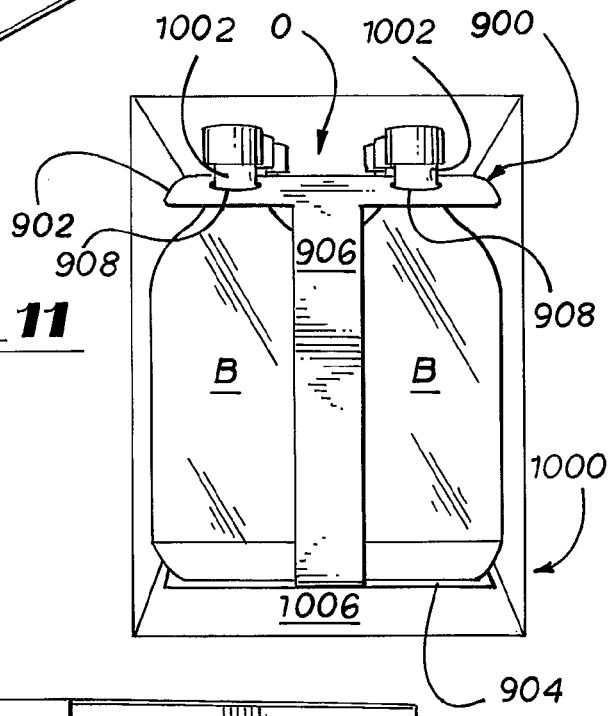
Fig_11
Fig_12
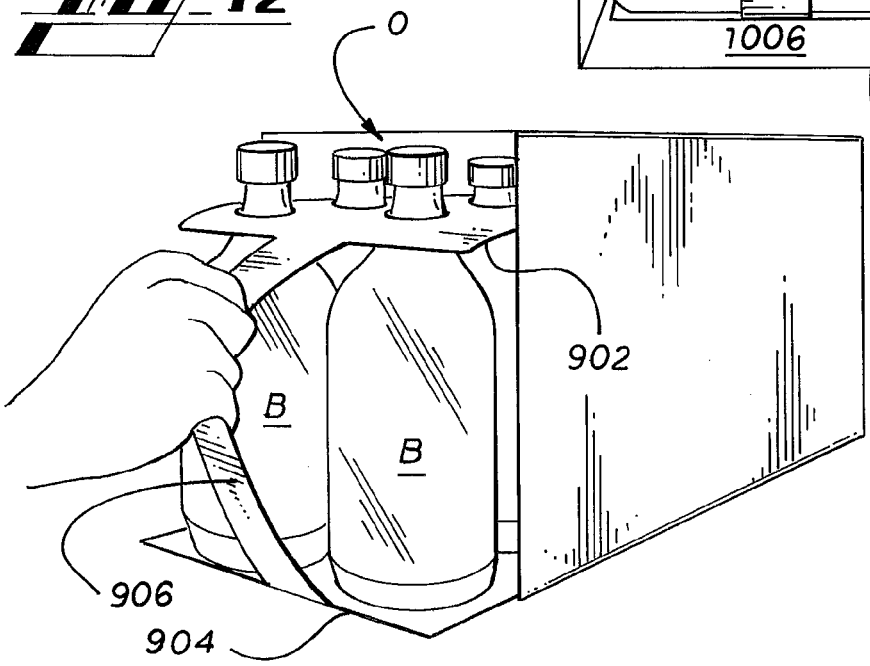

Fig. 17
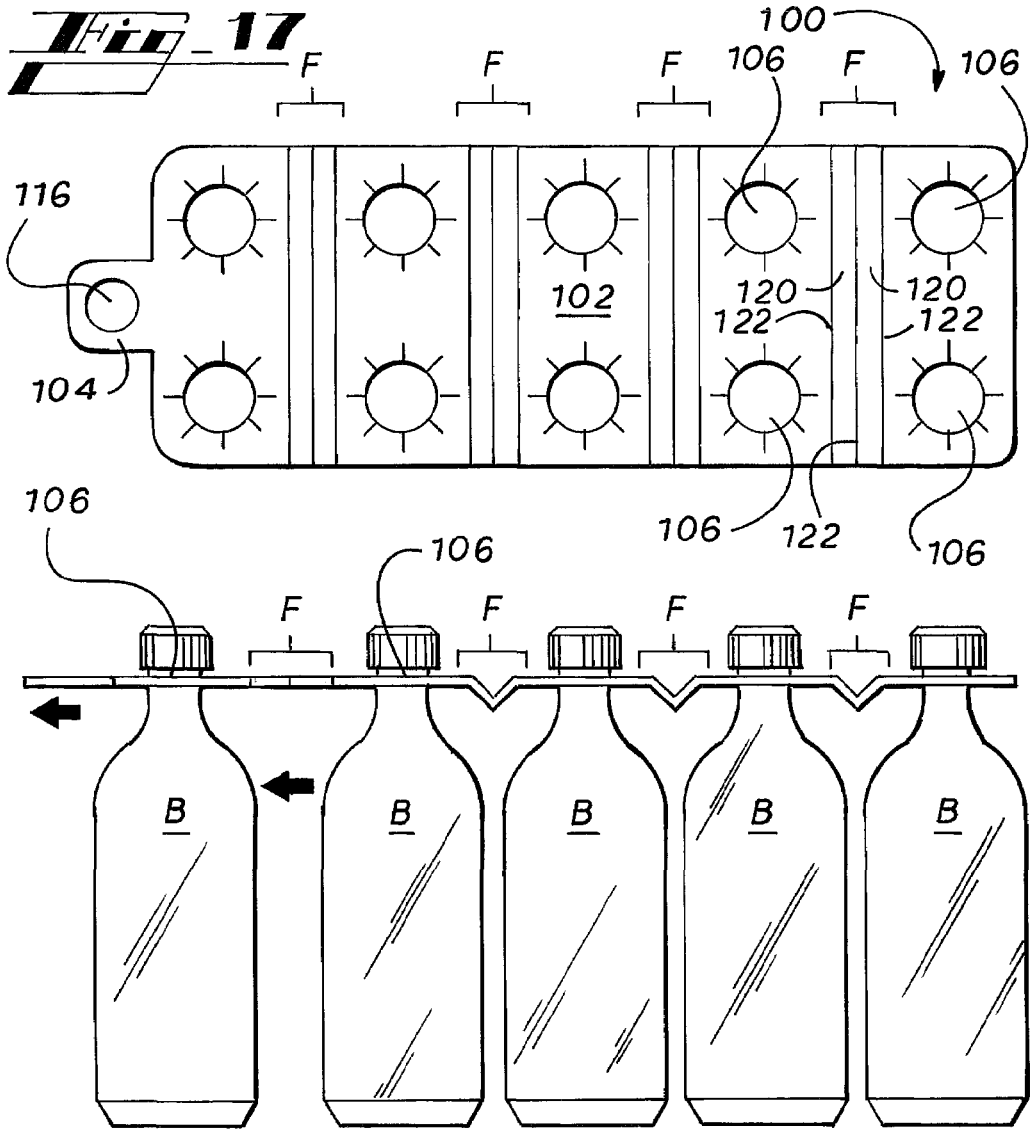
Fig. 18
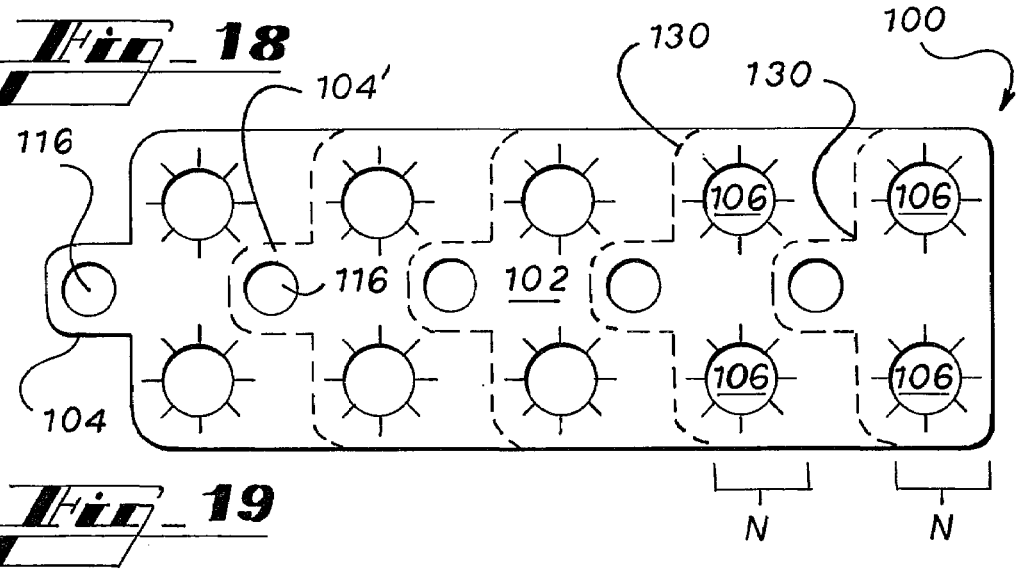
Fig. 19

PRODUCT DISPENSING AIDS

CROSS REFERENCE TO RELATED APPLICATIONS

This application claims priority to U.S. Application No. 60/683,455, filed May 20, 2005, the contents of which are incorporated herein by reference.

TECHNICAL FIELD

This invention relates generally to cartons for enclosing and dispensing multiple articles, and more specifically to dispensing aids for facilitating the removal of articles from cartons.

BACKGROUND OF THE INVENTION

Cartons for enclosing and dispensing articles are known. Many such cartons are formed from a blank that is partially erected as a tubular sleeve and is loaded from either or both ends with articles, such as bottles or cans. The ends of the loaded carton are sealed, and the package is transported to a retail establishment for sale to end users. An end user will often store such a package on a shelf in a pantry or a refrigerator, and will then use the carton as a dispenser for dispensing one or more articles at a time. Many cartons include detachable sections to facilitate opening and retrieving the articles. However, certain of the articles may be difficult to access, particularly after the carton has been partially emptied. To access such articles, the user may have to tilt the carton to cause articles to roll toward the opening or may need to reach far inside the opening of the carton. These access methods may be inconvenient or impossible in the areas where the packages are stored.

What is needed, therefore, is a dispensing aid that facilitates convenient access to each of the articles in a carton.

SUMMARY OF THE INVENTION

The various embodiments of the present invention overcome the shortcomings of the prior art by providing a dispensing aid that draws or displaces at least some of the articles in a carton or other container toward an opening in the carton through which articles are dispensed, thereby facilitating access to all of the articles. The dispensing aid allows the user to incrementally or gradually displace all or some of the articles enclosed in a carton so that the articles can be positioned adjacent to or in registry with the opening for easy removal. The dispensing aid is particularly useful in tubular sleeve-type cartons, as it does not prevent articles from being end-loaded. In fact, certain embodiments improve the process of loading articles by grasping the articles prior to loading. The dispensing aid is easily assembled for loading into the carton and requires relatively few, if any, folding operations. The dispensing aid includes a convenient and ergonomic grip or other means for displacing the dispensing aid and, thereby, to draw the articles toward the carton opening. Advantageously, as articles are removed from the carton, certain embodiments of the dispensing aid prevent the remaining articles from rolling around or toppling over inside the carton.

Generally described, the dispensing aid of the various embodiments of the invention is particularly designed for use in a fully or partially enclosed carton that encloses multiple articles. The carton encloses articles, such as bottles or like containers, in columns and rows. The articles can, for example, be a two by three (2×3) or three by four (3×4) arrangement, although the number and configuration of enclosed articles may vary. The carton includes a plurality of walls that are hingedly connected to one another. The exemplary carton also includes an opening which provides a dispenser for removing articles from the carton. The opening can be formed in one or more of the walls by any one of several known methods for creating an opening in a carton. For example, the opening can be formed by providing an at least partially detachable section of the carton that is defined by any combination of severance lines, frangible lines, perforations, tear lines, tear strips, and the like. In certain embodiments, the opening is formed by removing an end wall of the carton. In other embodiments, the opening is formed at least in part by removing a portion of the top wall of the carton. The opening may be formed in any one or in a combination of the walls of the carton, and may be situated near an end of the carton or at any other position that is conducive for gaining access to articles within.

The dispensing aid is deployed or otherwise operatively associated with the articles at substantially the same time as loading articles into the carton or prior to loading the articles into the carton. Alternatively, the dispensing aid can be inserted into the carton after the articles are loaded into the carton.

Each dispensing aid includes means for engaging articles that is displaceable toward the opening of the carton and, in certain embodiments, means for displacing the means for engaging toward the opening of the carton. The means for engaging articles includes an article engaging portion of the dispensing aid that is operatively associated with the articles in such a manner as to transfer force that is applied to the dispensing aid to the articles. The force displaces the articles as the dispensing aid is displaced. In other words, if the article engaging portion is displaced, such as by a force pulling toward the carton opening, the articles are also pulled toward the carton opening, and experience an equal, proportionate, or disproportionate displacement. The article engaging portion is operatively associated with the articles by contacting at least some of the articles so as to engage any part of the articles contacted, including the upper portions, lower portions, necks, tops, caps, bottoms, or sides. Means for engaging may one of, or a combination of, a top-engaging collar, a bottom-engaging sled, a rear-engaging crossbar, and a side-engaging belt.

In embodiments in which articles that are enclosed in the carton are arranged in rows, the opening is sufficiently large as to expose articles in at least one of the rows for removal. Further, means for engaging is for engaging articles in at least the furthest row from the opening. Thereby, displacement of the means for engaging toward the opening displaces the furthest row of articles and each intervening row toward the opening.

In certain embodiments, the dispensing aid includes means for displacing the means for engaging toward the opening. The means for displacing is connected to or operatively associated with the means for displacing. For example, the means for displacing may be a grip, handle, hook, loop, pull tab, pull bar, flange, lip, flap, finger hold, T-bar, tassel, grommet, strap, cord or similar means for enabling a user to grasp or otherwise engage the article engaging portion in order to pull, push, or otherwise urge the articles toward the opening. In the exemplary embodiments, means for displacing is disposed at or near the opening of the carton, and is positioned to enable the user to engage the means for displacing while all or some articles remain in the carton. Alternatively, means for displacing may be accessible via an additional aperture that is made in the carton.

The article engaging portion is stamped, cut, or otherwise formed from a blank comprising a substantially flat sheet of a preferably foldable or deformable material of density that is selected for the intended use. Suitable materials include paperboard, corrugated board, plastic, fabric, rubber, and the like. The dimensions of the means for engaging correspond to the dimensions of the interior of the carton and to the dimensions of the articles, so that the means for engaging is sized to fit in the carton while being easily displaceable.

In the embodiments described herein, the means for engaging is formed from the same blank as the means for displacing, thereby being a contiguous appendage. Alternatively, the means for displacing is secured to the means for engaging by any suitable means for securing, including but not limited to glue, tape, staples, rivets, magnets, non-permanent adhesives, hook and loop fasteners such as VELCRO®, which is a trademark registered to Velcro Industries B.V., and the like. The means for displacing may be selectively detachable and attachable in certain embodiments. The blank is preferably a single sheet, although the means for engaging may be formed from several sheets comprising a single blank, or from multiple interlocking blanks.

In certain embodiments, the dispensing aid is configured to be deployed in a carton that encloses several elongated articles such as bottles, having upper portions comprising necks and/or caps that may be somewhat tapered. Means for engaging for the dispensing aid includes a collar for receiving the upper portion of the articles. Specifically, the collar is defined by several spaced apertures that are disposed through the surface of the dispensing aid. Each aperture receives or engages the neck or upper portion of each of the articles. The apertures are preferably arranged in columns and rows, creating a matrix pattern on the surface of the dispensing aid. The spacing between the apertures is sufficient to provide adequate distance between adjacent articles to protect the articles from rubbing together or breaking. A grip or other means for displacing is connected to the collar at a point that is nearest the opening of the carton.

In certain embodiments, at least one of row of articles is positioned adjacent to the opening of the carton and is not engaged by means for engaging of the dispensing aid. This foremost row of articles, which is closest to the opening, is easily accessed via the opening without being displaced by a dispensing aid. The means for displacing, such as a grip, may be exposed after the foremost row of articles is removed and is accessible to allow the user to take hold of the grip and displace the dispensing aid toward the opening. Thereby, the successive row of articles is positioned for removal from the carton.

In certain other embodiments, means for engaging includes a sled for engaging at least a lowermost surface of at least the furthest row of articles from the opening in a supportive manner. That is, at least a portion of the sled bears at least some of the weight of the articles so that the articles are drawn along with the sled as the sled is displaced. When the sled is drawn or otherwise displaced toward the opening of the carton, the articles supported by the sled are also displaced toward the opening. The foremost articles, or the articles that are otherwise in registry with the opening, can be removed from the carton, exposing means for displacing the means for engaging, such as a grip. The user engages the grip and displaces the sled toward the opening, thereby positioning the next row of articles for removal from the carton.

In certain other embodiments, means for engaging includes an article engaging portion that engages the side of one or more of the articles. In the exemplary version of these embodiments, the article engaging portion includes a crossbar that is disposed to engage a surface of articles in the row that is the furthest from the opening. The crossbar is disposed between the surface of the articles and the end wall of the carton. A pull bar is disposed between two columns of the articles and includes a first end that is attached to the crossbar. The user pulls the pull bar in the direction of the opening, thereby displacing the crossbar and urging the articles toward the opening of the carton. Means for displacing the crossbar includes a grip that is attached to a second end of the pull bar to facilitate grasping the pull bar.

In other embodiments, means for engaging includes a belt extending around the group of articles. The belt is disposed between the walls of the carton, including the side walls and rear end closure, and the side surfaces of the articles such that the ends of the belt extend toward the opening of the carton. Means for engaging, such as tabs, are disposed at each end of the belt. The tabs are simultaneously pulled to displace the group of articles toward the opening.

In certain other embodiments, the article engaging portion includes a combination of the aforementioned features, including any combination of collars, sleds, crossbars, or belts. The dispensing aid may also include any number of grips of various configurations.

In embodiments where the articles are arranged in rows, means for engaging may include severance lines disposed between adjacent rows to define detachable portions of the means for engaging. The detachable portions of the means for engaging can be detached along the severance line to separate a row of articles from the remaining rows of articles, which are engaged by the remaining portion of the means for engaging. Thus, each row can be successively detached from the means for engaging as desired and the remaining means for engaging does not excessively extend or protrude from the opening. The severance line may define means for displacing the remaining portion of the means for engaging.

In other embodiments where the articles are arranged in rows, means for engaging may include a flexible section that is disposed between adjacent rows of articles such that the rows are independently displaceable from one another. The flexible section buffers the displacement of successive rows such that, for example, as the foremost row of articles is displaced, the successive rows of articles are not displaced.

The foregoing has broadly outlined some of the aspects and features of the present invention, which should be construed to be merely illustrative of various potential applications of the invention. Other beneficial results can be obtained by applying the disclosed information in a different manner or by combining the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

BRIEF DESCRIPTION OF THE DRAWINGS

FIG. 2 is a perspective view of a package including a carton having an end wall removed to show the dispensing aid of FIG. 1.

FIG. 3 is a perspective view of the package of FIG. 2, showing the package after one row of articles has been removed.

FIG. 4 is a perspective view of the package of FIG. 2, showing the package after the dispensing aid has been used to draw articles toward the carton opening.

FIG. 10 is a perspective view of a package including a carton having an end wall removed to show the dispensing aid of FIG. 7.

FIG. 11 is a perspective view of the package of FIG. 9 showing the package after one row of articles has been removed.

FIG. 12 is a perspective view of the package of FIG. 9 showing a user operating the dispensing aid to draw articles toward the carton opening.

FIG. 17 is a plan view of the dispensing aid of FIG. 1, the dispensing aid including flexible sections.

FIG. 18 is a side elevation view of the dispensing aid of FIG. 17 showing the displacement of a row of articles.

FIG. 19 is a plan view of the dispensing aid of FIG. 1, the dispensing aid including severance lines which define detachable portions.

DETAILED DESCRIPTION

Figure 1:
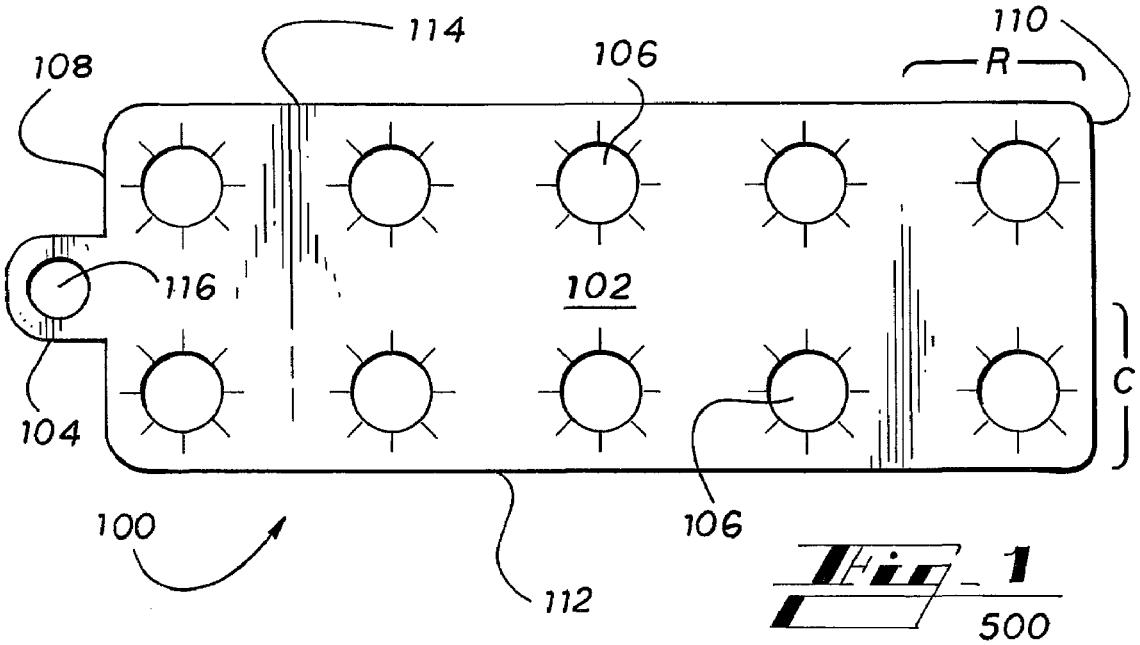
FIG. 1 is a plan view of a dispensing aid according to one embodiment of the present invention.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings, in which like numerals indicate like elements throughout the several views, the drawings illustrate certain of the various aspects of exemplary embodiments of various dispensing aids for facilitating removal of articles from a carton having an opening or a detachable portion for dispensing articles. The various embodiments of the invention are described in the context of deployment in an exemplary tubular sleeve type carton having a top wall, bottom wall, two side walls, and two end walls, although the dispensing aid may be deployed in any type or configuration of container. The opening for dispensing articles may be formed by removing or opening one of the end walls, which may be an end closure structure that is formed from end flaps and end wall panels which are secured together. Alternatively, the opening for dispensing articles may be formed by at least partially detaching a portion of one or more of the aforementioned walls.

FIG. 1 is a plan view of a first embodiment of a dispensing aid 100 of the present invention. The dispensing aid 100 includes means for engaging articles. In this embodiment, means for engaging articles includes an article engaging portion of the dispensing aid 100, shown as a collar 102. The dispensing aid 100 also includes means for displacing the means for engaging, which is shown as a grip 104. The dispensing aid 100 includes two columns C and five rows R of apertures 106, each aperture 106 being for receiving the neck or other portion of an article (not shown) enclosed in the carton 200 (best shown in FIG. 2). As shown, the collar 102 is substantially rectangular in shape, having a front edge 108, a rear edge 110, and two elongated side edges 112, 114. Those skilled in the art will readily appreciate that the apertures 106 are merely examples of suitable means for receiving the upper portions of articles, and may be replaced with depressions, notches, or cutouts extending only partially through the collar 102, wherein each means for receiving has a width and depth that is sufficient to receive a portion of an article, and to transfer forces to the article, thereby causing the articles in at least the rearmost row to be displaced along with the dispensing aid 100. As used herein, the rearmost row of articles refers to the row of articles that is furthest from the opening of the carton and the foremost row of articles refers to the row of articles that is closest to or in registry with the opening of the carton.

The grip 104 is connected to the front edge 108 of the collar 102 and extends outwardly with respect to the collar 102 in a direction that is substantially parallel to the axis of elongation of each column C. The grip 104 includes a finger hold 116 for engaging the grip 104 with one or more of a user's fingers. The grip 104 functions substantially as a pull tab, allowing a user to engage the grip 104 and, by pulling the grip 104, to displace the collar 102 of the dispensing aid 100.

Referring now to FIG. 2, the dispensing aid 100 is deployed in exemplary carton 200. The carton 200 has a top wall 202, two side walls 204, 206, a bottom wall 208, and a rear end closure 210 (obstructed). The front end closure (not shown) has been removed to create an opening O. The carton 200 is configured to enclose twelve bottles B in a 2×6 arrangement, although the embodiments of the dispensing aid can be configured to accommodate any number of article configurations and carton designs.

The upper portion of each bottle B includes a neck 212 and a cap 214. In all but the first row of bottles B, the upper portion of each bottle B extends through one of the apertures 106 in the collar 102. When deployed in a carton 200, the front edge 108 of the dispensing aid of 100 is disposed behind, and may engage, the rear-facing sides of the bottles B in the first row of bottles B and the grip 104 extends between the necks 212 of the bottles B in the first row of bottles B. In this manner, bottles B in an unattached first row R are easily accessible without operating the dispensing aid 100, because the bottles B in this first row are closest to the open end or opening O of carton 200.

After the bottles B in the first row have been removed from the carton 200, the second row of bottles B is exposed as shown in FIG. 3, and can be drawn toward the opening O, along with the four other remaining rows of bottles B, by operating the dispensing aid 100. To operate the dispensing aid 100, the user engages the grip 104 by inserting a finger or several fingers into the finger hold 116. The user pulls the grip 104 toward the opening O, thereby uniformly displacing the bottles B in the remaining five rows, and drawing the remaining bottles simultaneously toward the opening O. Referring to FIG. 4, once the bottles B in the second row are in registry with the opening O, the user can easily remove them before drawing the remaining four rows toward the opening O, and so on. Each bottle B can be removed from the dispensing aid 100, for example, by pulling the bottle B downward somewhat to free the upper portion of the bottle B from the aperture 106.

In an alternative embodiment, the dispensing aid 100 may include a flexible section such that the rows of bottles B are not uniformly displaced as the dispensing aid 100 is operated. For example, the dispensing aid 100 can include elastic, or stretchable, material or accordioned panels such that a certain amount of play, or otherwise a buffer, is introduced between rows of bottles B. Referring to FIGS. 17 and 18, a flexible section F includes accordioned panels 120 that are disposed between rows of apertures 106 and defined by fold lines 122. The accordioned panels 120 are initially disposed in a folded condition and expand to a substantially flat condition such that each row of articles or bottles B can be separately displaced toward the opening O of a carton. In other words, the dispensing aid 100 can be operated to pull one row of bottles B toward the opening O without pulling out the next row of bottles B.

In another alternative embodiment, the dispensing aid 100 may include severance lines 130 that are disposed between adjacent rows of apertures 106 to define detachable portions N of the collar 102. The detachable portions N of the collar 102 can be detached along a severance line 130 to separate a row of articles from the remaining rows of articles engaged by the collar 102. Thus, each row of articles can be successively removed from a carton by detaching a detachable portion N. Advantageously, the collar 102 does not excessively extend from the opening of a carton when the detachable portion N is removed along with a row of articles. In this embodiment, a portion of each severance line 130 defines a grip 104' including a finger hold 116' for displacing the remaining portion of the sled 102 after each detachable portion N is removed.

Figure 5:
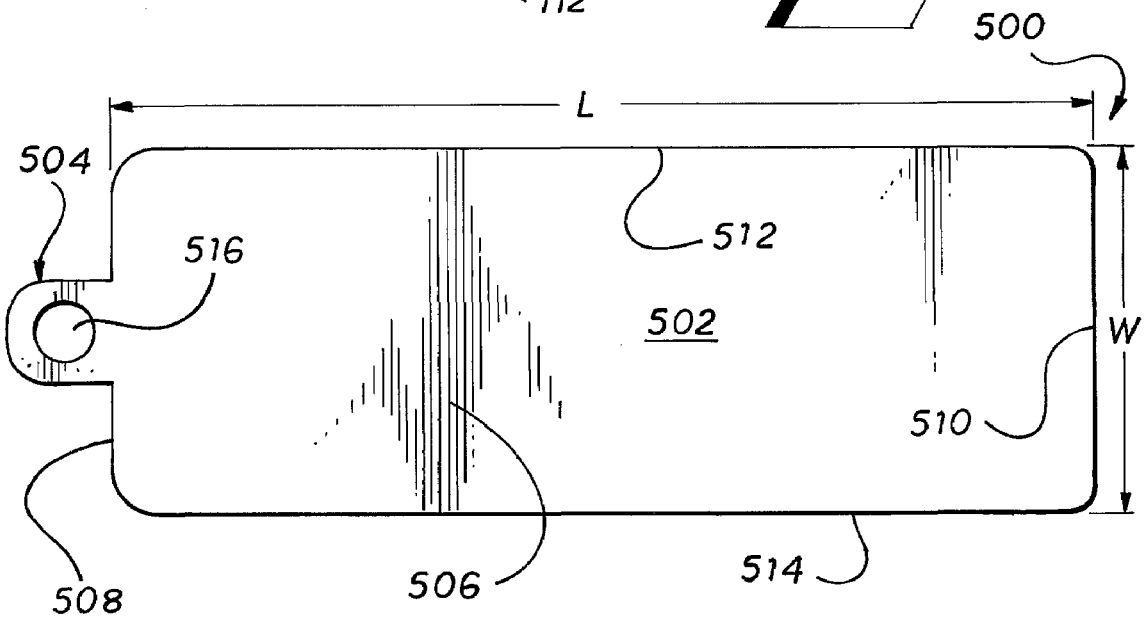
FIG. 5 is a plan view of a dispensing aid according to a second embodiment of the present invention.

FIG. 5 is a plan view of a dispensing aid 500 according to a second embodiment of the present invention. The dispensing aid 500 includes means for engaging articles. In this embodiment, means for engaging articles includes an article engaging portion of the dispensing aid 500, shown as a sled 502. The dispensing aid 500 also includes means for displacing the means for engaging, which is shown as a grip 504 that is integrally attached. The surface 506 of the sled 502 is substantially flat or includes features (not shown) that engage the lower portion of articles such as bottles B (shown in FIG. 6) enclosed in the exemplary carton 600. Examples of suitable lower portion engaging features include raised ridges, skids, egg-crating, corrugations, impressions that conform to the shape of the lower portion of the articles, depressions, slip resistant materials, and the like. The sled 502 and its engaging features may be formed together from a homogenous material or may be formed from multiple layers or multiple types of materials, such as by laminating a layer of rubber to a layer of paperboard. In any event, those skilled in the art will readily comprehend that the sled 502 is substantially slip resistant. That is, the texture or topography of the surface 506, or the static coefficient of friction of the surface 506, is sufficient to overcome the tendency of the articles to slide off the surface 506 as the article engaging portion, or sled 502, is pulled toward the opening O of the carton 600. Thus, the texture and topography of the surface 506 of the sled 502 is a design choice that depends on such factors as the weight of the articles (shown as bottles B in FIG. 6), the number and configuration of the articles, the clearance between the articles and the carton walls 602, 604, 606, the shape and height of the articles, the slip resistance of the surface of the articles, and the like.

Figures 6, 15, 16:
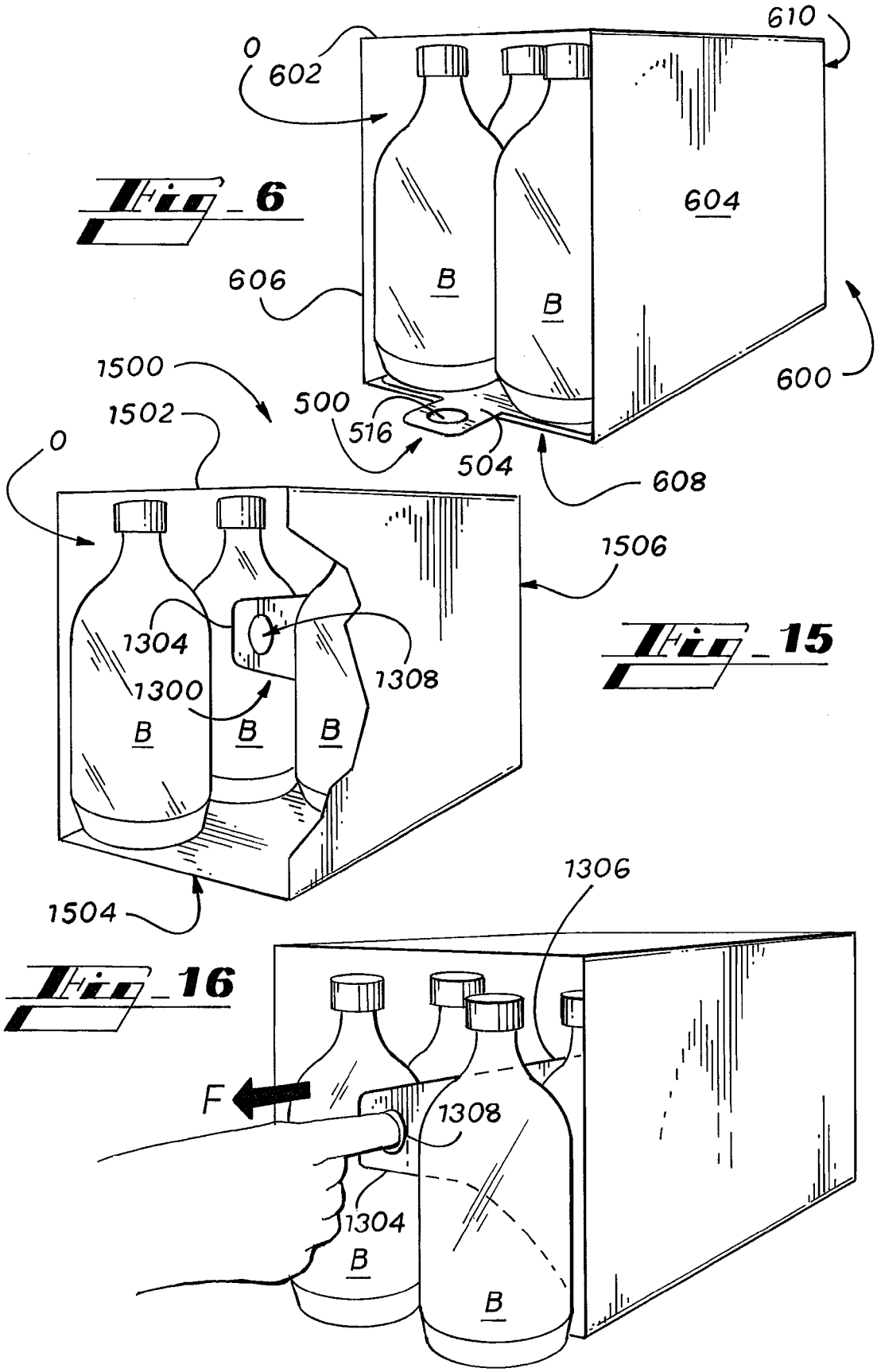
FIG. 6 is a perspective view of a package including a carton having an end wall removed to show the dispensing aid of FIG. 5.
FIG. 15 is a perspective view of a package including a carton with an end wall removed to show the dispensing aid of FIG. 13, the package being shown after an article has been removed.
FIG. 16 is a perspective view of the package of FIG. 15, showing a user operating the dispensing aid to draw articles toward the carton opening.

With reference to FIGS. 5 and 6, the width W of the sled 502, as measured along front and rear edges 508, 510, is sufficient to support and convey both columns C of bottles B. The length L, as measured along side edges 512, 514, is sufficient to convey at least the rearmost row R of bottles B, which is not easily accessible without displacing the bottles B toward the opening O. In the embodiment shown, all rows of bottles B rest upon the surface 506 of the sled 502, although it is contemplated that the length L of the sled 502 may be limited such that the sled 502 is disposed beneath all but the first row or rows of bottles B.

A grip 504, analogous to the grip 104, is integrally connected to the sled 502, although it may alternatively be secured thereto by any suitable means for securing, including but not limited to tape, glue, staples, rivets, and the like. The grip 504 is connected to the front edge 508, and is preferably centered to equally distribute the columns C of bottles B. As shown in FIG. 6, the grip 504 is centered between the two columns, and extends toward the opening O.

The dispensing aid 500 is deployed in exemplary carton 600 having a top wall 602, two side walls 604, 606, a bottom wall 608 and a rear end closure 610 (obstructed). The front end closure (not shown) has been removed to create an opening O. The dispensing aid 500 rests on the inner surface of the bottom wall 608, with at least the rearmost rows of bottles B disposed on the upper surface 506. As depicted in FIG. 6, the bottles B are arranged in two columns and any practical number of rows, such as a 2×6 arrangement.

The bottles B in the first (endmost) row can easily be removed from the carton 600 with or without operating the dispensing aid 500. The remaining rows of bottles B are then exposed, and can be drawn toward the opening O via operation of the dispensing aid 500. To operate the dispensing aid 500, the user engages the grip 504 by inserting a finger or several fingers into the finger hold 516. The user pulls the grip 504 toward the opening O, thereby uniformly or predictably displacing the remaining rows R of bottles B, and drawing the bottles B simultaneously toward the opening O. Once the bottles B in the next row R are in registry with the opening O, the user can easily remove them before drawing the then remaining rows toward the opening O, and so on. Each bottle B can be removed from the dispensing aid 500 by simply lifting the bottle B off the surface 506 of the sled 502 and out of the carton 600 through the opening O.

Figure 8:
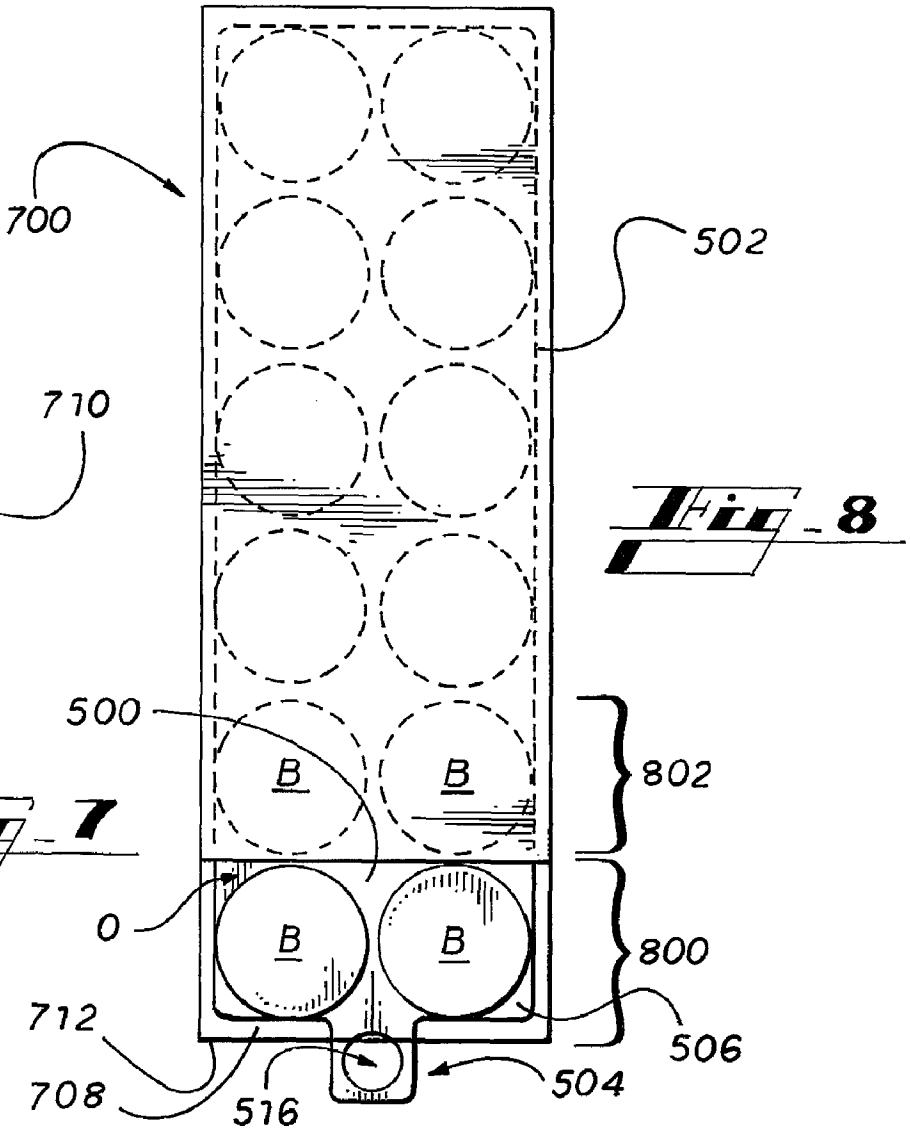
FIG. 8 is a plan view of the dispensing aid of FIG. 5 in the carton of FIG. 7.
Figure 7:
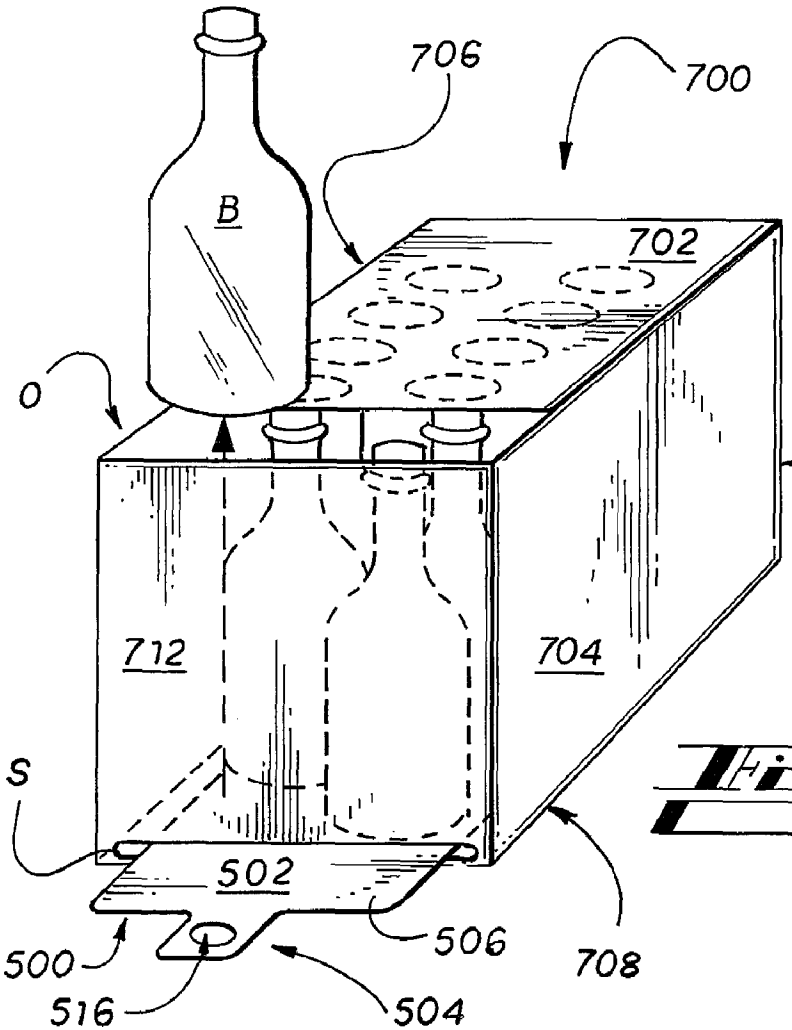
FIG. 7 is a perspective view of a package including a carton with an opening in its top wall, the package being shown after the dispensing aid of FIG. 5 has been used to draw articles toward the opening of the carton.

The aforementioned dispensing aid 500 is well suited for an application in which a carton includes an opening that, at least part of which, is disposed in a wall other than an end wall. For instance, in FIG. 7 the opening O is disposed in a top wall 702 of a carton 700, and may alternatively extend onto one or more of the side walls 704, 706 or onto one or more of the end walls 710, 712. The dispensing aid 500 rests slidably on the bottom wall 708, as depicted in FIG. 8. Prior to dispensing any items through the opening O, at least portion of the grip 504 extends through an elongated aperture or slit S (shown in FIG. 7). The first row 800 of bottles B that are enclosed in the carton 700 is the endmost row which is closest to end wall 712 when the carton is full. Thereby the first row 800 of bottles B is easily accessible via the opening O without operating the dispensing aid 500. In embodiments in which the opening O is situated near the center of the top wall 702, the first row is a row that is in registry with the opening O when the carton 700 is full. To access the bottles B in a second row 802 after articles in the first row 800 have been removed, the user engages the grip 504 and pulls away from the end wall 712, thereby gradually pulling the sled 502 through the slit S, until the second row 802 is in registry with the opening O.

It should be noted that, to accommodate providing a selectable opening O or multiple openings O in the top wall 702, slits S and grips 504 may be provided at opposite ends of the carton 700 and of the sled 502. In this manner, the user can determine which opening O is desirable and operate the dispensing aid 500 to move articles B toward that opening O.

Figure 9:
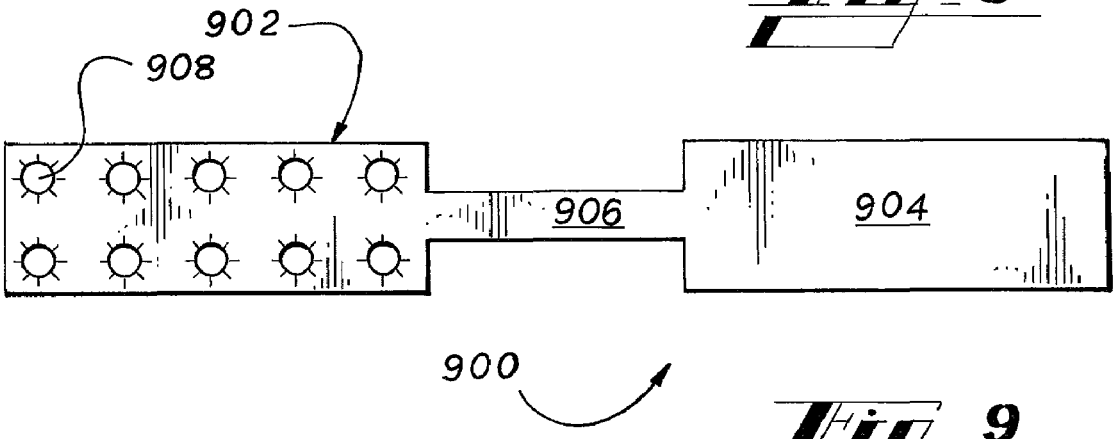
FIG. 9 is a plan view of a dispensing aid according to a third embodiment of the present invention.

A third embodiment is shown in FIG. 9. Dispensing aid 900 includes means for engaging articles. In this embodiment, means for engaging articles includes an article engaging portion of the dispensing aid 900, shown as a collar 902 and a sled 904. The dispensing aid 900 also includes means for displacing the means for engaging an article, which is shown as an elongated strap 906 that interconnects the collar 902 and the sled 904. The collar 902 is similar to the neck-receiving type collar 102 of the first embodiment such that it includes a plurality of columns C and rows R defining a array of apertures 908 that are disposed at least partially therethrough. Thus, the dispensing aid 900 shown can be deployed in a carton enclosing ten articles in two columns and at least five rows—a 2×5 arrangement. The sled 904 is similar in form and function to the sled type article engaging portion 504.

Referring now to FIG. 10, the dispensing aid 900 is deployed in an exemplary carton 1000, which encloses twelve articles B in a 2×6 arrangement. The collar 902 is operatively associated with the upper portions of at least the rearmost row of bottles B. More specifically, necks 1002 of all but the first row of articles B are disposed through the apertures 908 in the collar 902. The sled 904 is disposed beneath at least the rearmost row of bottles B. In this embodiment the rearmost row of bottles B is that which is adjacent to an end wall 1004 of the carton 1000. The strap 906 may be disposed anywhere between the first row or rows of articles and the rearmost row of articles. Specifically, in the embodiment shown, the strap 906 is disposed between the first and second rows of bottles B, and is centered between the two bottles B in the second row of bottles B in the carton 1000. After the first row of bottles B is removed, as shown in FIG. 11, the strap 906 is accessible, and the dispensing aid 900 is operated by pulling the strap 906 toward and through the opening O, as shown in FIG. 12. Accordingly, the bottles B are urged toward the opening O, and toppling or splaying of the bottles B is prevented by the sled 904, which slides easily over the bottom wall 1006.

Figure 13:
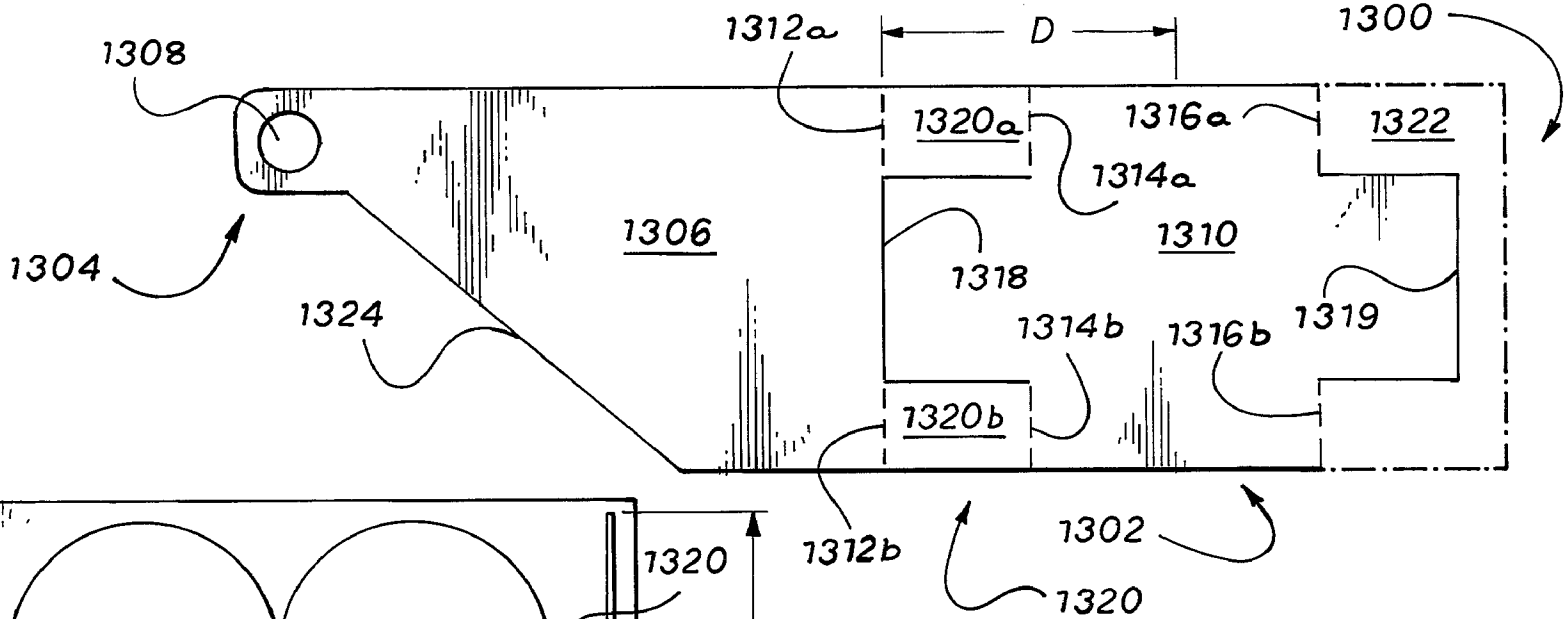
FIG. 13 is a plan view of a dispensing aid according to a fourth embodiment of the present invention.

FIG. 13 is a plan view of a dispensing aid 1300 according to a fourth embodiment of the present invention. The dispensing aid 1300 includes three major sections: an article engaging portion 1302, a grip 1304 that includes a finger hold 1308, and a pull bar 1306, all struck from a single blank. More specifically, the article engaging portion 1302 includes a crossbar 1310, a hinge 1320, and an optional flap 1322. The hinge 1320 comprises an upper portion **1320*a* and a lower portion 1320*b*, which are hingedly connected to pull bar 1306 along respective fold lines 1312*a*, 1312*b* and are hingedly connected to crossbar 1310 along respective fold lines 1314*a*, 1314*b*. Crossbar 1310 is hingedly connected to optional flap 1322 along optional fold lines 1316*a*, 1316*b*. Crossbar 1310 is further defined by severance line 1318, which extends longitudinally from fold line 1314*a* to fold line 1312*a*, transversely between fold lines 1312*a*, 1312*b*, and longitudinally from fold line 1312*b* to fold line 1314*b*. Crossbar 1310 is also further defined by severance line 1319, which extends from fold line 1316*a* and defines three sides of a rectangle before meeting fold line 1316*b*. In embodiments lacking the optional flap 1322, fold lines 1316*a*, 1316*b* and severance line 1319 instead define an end edge of the crossbar 1310**.

Figure 14:
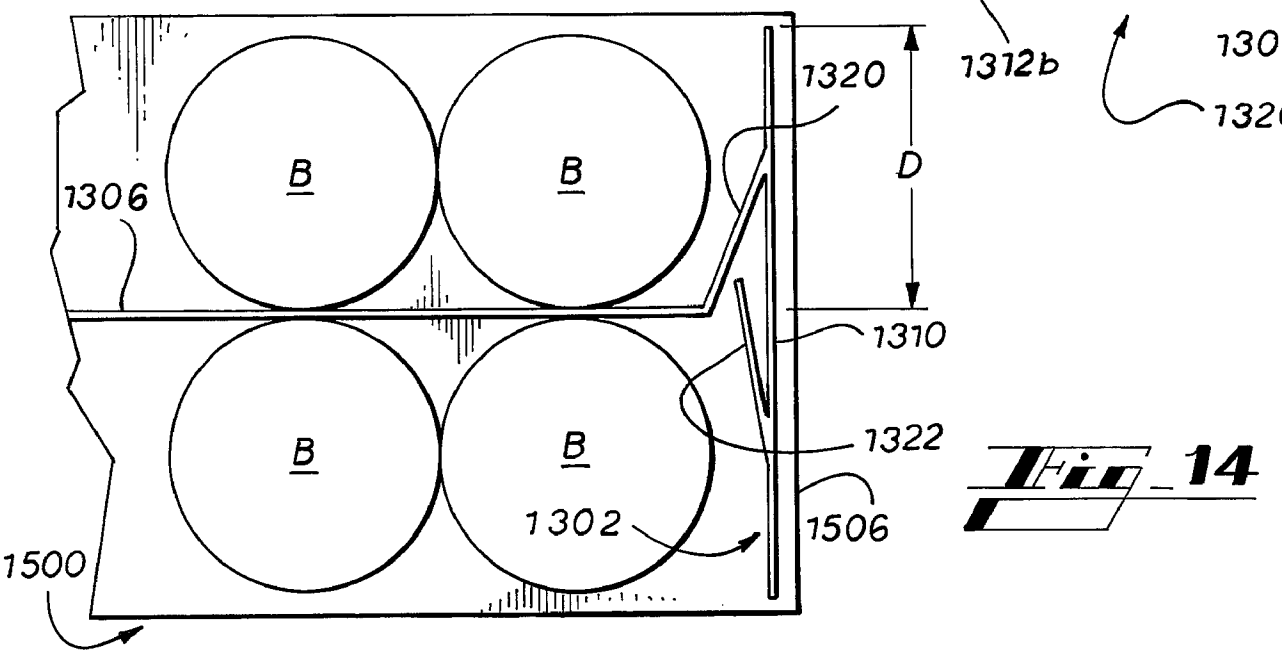
FIG. 14 is a partial plan view of a package including a carton with the top wall removed to show the dispensing aid of FIG. 13 the dispensing aid being at least partially assembled and deployed in the carton.

As shown in FIG. 14, the dispensing aid 1300 is assembled into a substantially T-shaped formation by performing several folding operations, and preferably by securing the folds with an adhesive or other means for securing. For ease of description, assembly of the dispensing aid will be described with reference to FIGS. 13 and 14, with the surface shown being referred to as the "outer surface". Optional flap 1322 is folded toward crossbar 1310 along fold lines **1316*a*, 1316*b* so that the outer surfaces thereof are in a face contacting arrangement. Hinge 1320 is folded toward crossbar 1310 along fold lines 1314*a*, 1314*b* so that the outer surfaces thereof are in a face contacting relationship as well. The outer surface of hinge 1320 may be secured to the inner surface of optional flap 1322 to maintain this configuration. Pull bar 1306 is rotated along fold lines 1312*a*, 1312*b* until the pull bar 1306 is substantially perpendicular to the plane of crossbar 1310**.

The dispensing aid 1300 is now ready for deployment in a carton 1500 (shown in FIG. 15). If the carton 1500 has been previously loaded with bottles B, the dispensing aid 1300 may be drop loaded through the top or bottom of the carton 1500 prior to securing the respective top wall 1502 or bottom wall 1504. It may be more practical to group the bottles B in the desired arrangement prior to loading and to deploy the dispensing aid 1300 in its operative position with respect to the bottles B, and then to load the group of bottles B through either or both open ends of the carton 1500, before closing the end walls 1506, 1508 (not shown). Alternatively, the dispensing aid 1300 may be deployed within carton 1500 prior to loading the bottles B.

The dispensing aid 1300 is operatively associated with the bottles B as follows. Referring to FIG. 14, the crossbar 1310 is positioned between the rearmost row of bottles B and the rear wall 1506. The pull bar 1306 is disposed between the centermost columns of bottles B and extends toward the opening O of the carton 1500 such that the grip 1304 is accessible when the carton 1500 is first opened, or after at least one bottle in the first row or rows of bottles B has been removed, as shown in FIG. 15.

The user operates the dispensing aid 1300 as shown in FIG. 16 to draw bottles toward, and possibly through, the carton opening O. Specifically, a user inserts a finger or fingers into the finger hold 1308 and applies a pulling force F that is directed away from the carton opening O. The crossbar 1310 transfers the pulling force F along the pull bar 1306 such that the article engaging portion 1302 engages the back sides of the rearmost row of bottles B, thereby urging the rearmost row toward the opening, along with any rows that are in front of the rearmost row. Thus, in the fourth embodiment, means for engaging includes the article engaging portion 1302 and means for displacing the means for engaging includes the pull bar 1306 and the grip 1304.

To prevent bottles B from deforming the crossbar 1310 and possibly becoming trapped behind the crossbar 1310, the dispensing aid 1300 can be constructed of a relatively stiff grade of material that resists flexing under ordinary use. Furthermore, the width of the crossbar 1310 is at least the diameter D of a bottle B, such that bottles B in the outermost columns of the rearmost row are drawn by at least one half of the crossbar 1310, which extends at least to the center of the bottles B in the outermost columns. In FIG. 14, width of the crossbar 1310 is shown as being twice the diameter D and just less than the width of the carton, further ensuring that the bottles B do not escape.

In the embodiments shown, the pull bar 1306 includes an angled edge 1324 which may accommodate the shoulders of the bottles B or may simply reduce the amount of material consumed in manufacture. The vertical position of the grip 1304 and the height of the crossbar 1310 are determined in view of the height of the bottles B. To avoid toppling the bottles B, the height of crossbar 1310 is at least half the height of the bottles B. Similarly, the center of the finger hold 1308 in the grip 1304 is positioned vertically at about half the height of the bottles B.

The dispensing aid 1300, like dispensing aid 500, is well suited for application in a carton having an opening which is at least partially disposed in a wall other than an end wall. For example, in such cartons (not shown), the grip 1304 may extend through a vertical slit disposed in an end wall. As described herein, the user may pull the grip 1304 to draw the articles toward an opening that is disposed, at least in part, in the top wall of the carton.

With respect to dispensing aids 100, 500, and 1300, it is contemplated that frangible lines, such as perforations (not shown), can be provided to enable the user to tear off and discard portions of the collar 102, sled 502, and pull bar 1306 as each row of articles is removed from the carton to prevent excess portions of each from protruding from an end of the carton. It is also contemplated that the collar 102, sled 502, and pull bar 1306 may be bendable or otherwise deformable so that the excess portions can be simply folded out of the way. For example, with respect to FIG. 7, the sled 502 can be folded upward against the end wall 712 as the sled 502 is withdrawn from the carton 700.

Figure 20:
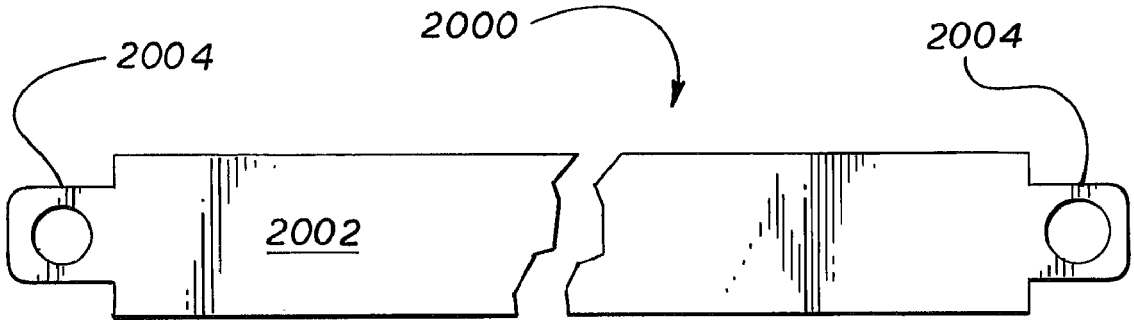
FIG. 20 is a plan view of a dispensing aid according to a fifth embodiment of the present invention.
Figure 21:
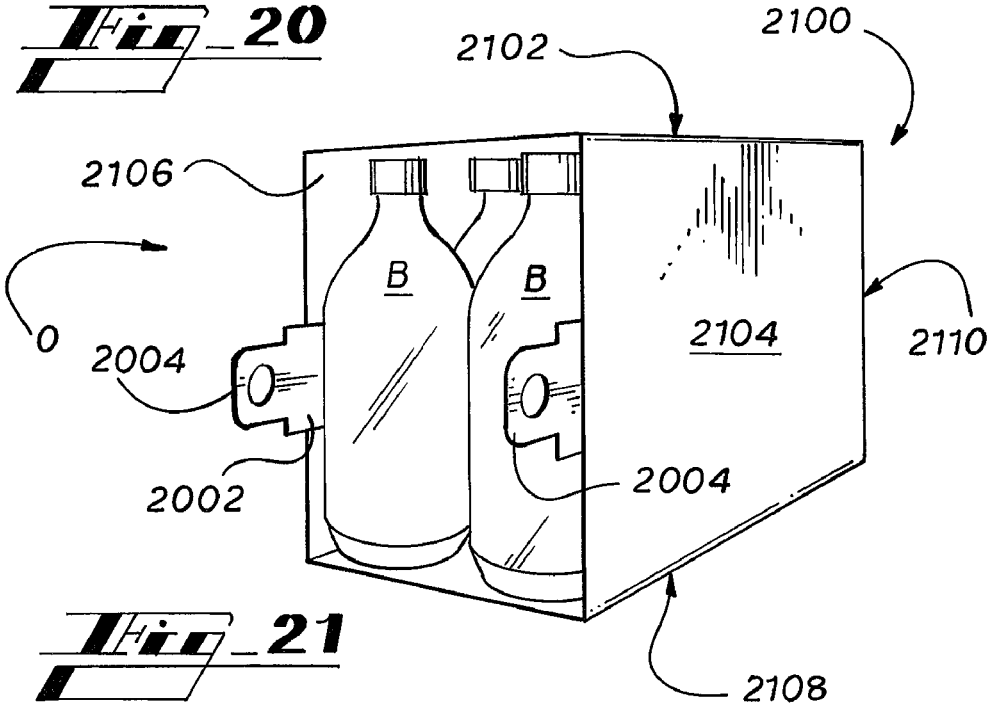
FIG. 21 is a perspective view of a package including a carton with an end wall removed to show the dispensing aid of FIG. 20.
Figure 22:
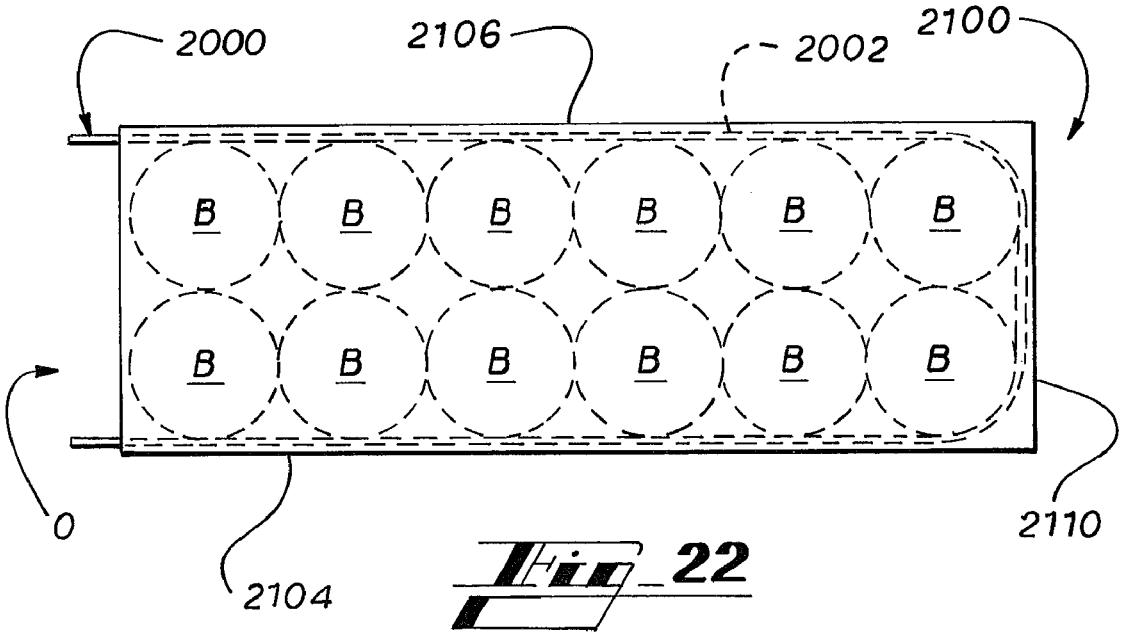
FIG. 22 is a top view of the package of FIG. 21.

FIG. 20 is a plan view of a fifth embodiment of a dispensing aid 2000 of the present invention. In this embodiment, means for engaging articles includes an engaging portion of the dispensing aid 2000, shown as a belt 2002. The dispensing aid 2000 also includes means for displacing the means for engaging, shown as grips 2004 which are disposed at opposite ends of the belt 2002. Referring to FIGS. 21 and 22, the belt 2000 is deployed in an exemplary carton 2100. The carton has a top wall 2102, side walls 2104, 2106, a bottom wall 2108, and a rear end closure 2110. The front end closure has been removed to create an opening O. The belt 2002 extends around the group of articles B and is disposed between the walls of the carton 2100, including the side walls 2104, 2106 and the rear end closure 2110, and the side surfaces of the articles B. The ends of the belt 2002 extend toward the opening O of the carton 2100. The grips 2004 are simultaneously engaged to displace the articles toward the opening O of the carton 2100.

The above-described embodiments are merely exemplary illustrations of implementations set forth for a clear understanding of the principles of the invention. Variations, modifications, and combinations may be made to the above-described embodiments without departing from the scope of the claims. For example, as used herein, directional references such as "top", "base", "bottom", "end", "side", "inner", "outer", "upper", "middle", "lower", "front" and "rear" do not limit the respective walls of the carton to such orientation, but merely serve to distinguish these walls from one another. Although each embodiment is described with respect to a carton having a single dispensing aid deployed therein, it should be noted that a single carton may include several dispensing aids. For instance, two dispensing aids 1300 may be deployed in a 4×6 carton, with each dispensing aid drawing two columns of articles. The grips 104, 504, and 1304 need not extend outwardly with respect to the respective collar 102, sled 502, and pull bar 1306. Rather, the associated finger holds 116, 516, and 1308 may be disposed directly in the respective collar 102, sled 502, and pull bar 1306 near the respective front edge 108, 508, 1324. Alternatively, the grips 104, 504, and 1304 need not be distinguishable from the edge 108, 508, 1324 at all. Rather, grips 104, 504, 1304 may comprise a flange, lip, or other grippable section that is contiguous or integral to the collar 102, sled 502, and pull bar 1306 or is disposed at or substantially near edge 108, 508, 1324, respectively. It is also contemplated that grips 104, 504, 1304 may or may not include finger holds 116, 516, 1308.

Any reference to a hinged connection should not be construed as necessarily referring to a junction including a single hinge only; indeed, it is envisaged that hinged connection can be formed from one or more potentially disparate means for hingedly connecting materials.

All such variations, modifications, and combinations are included herein by the scope of this disclosure and the following claims.

What is claimed is:

1. A package, comprising a plurality of articles arranged in rows;

a carton enclosing said articles, said carton comprising:

a plurality of walls hingedly connected one to another;

an opening formed in at least one of said walls said opening providing a dispenser for removing said articles from said carton;

a dispensing aid for displacing at least some of the articles toward said opening, wherein said dispensing aid comprises means for engaging at least one of said articles, said means for engaging being displaceable toward said opening so as to displace said at least some of said articles toward said opening, wherein said dispensing aid further comprises means for displacing said means for engaging toward said opening, wherein:

said means for engaging comprises a collar for receiving the upper portions of at least said articles in a furthest one of said rows from said opening; and said means for displacing comprises a grip connected to said collar.

2. A package, comprising:

a plurality of articles arranged in rows;

a carton enclosing said, articles, said carton comprising:

a plurality of hingedly connected one to another;

an opening formed mat least one of said walls, said opening providing a dispenser for removing said articles from said carton;

a dispensing aid for displacing at least some of the articles toward said opening, wherein said dispensing aid comprises means for engaging at least one of said articles, said means for engaging being displaceable toward said opening so as to displace said at least some of said articles toward said opening, wherein said dispensing aid further comprises means for displacing said means for engaging toward said opening, said means for engaging comprises:

a sled for supporting the lower portion of at least said articles in a furthest one of said rows from said opening; and a collar for receiving an upper portion of the at least one article that is engaged by the means for engaging; and said means for displacing comprises a strap interconnecting the collar to the sled.

3. A package, comprising:

a plurality of articles arranged in rows;

a carton enclosing said articles, said carton comprising:

a plurality of walls hingedly connected one to another;

an opening formed in at least one of said walls, said opening providing a dispenser for removing said articles from said carton;

a dispensing aid for displacing at least some of the articles toward said opening, wherein said dispensing aid comprises means for engaging at least one of said articles, said means for engaging being displaceable toward paid opening so as to displace said at least some of said articles toward said opening, wherein said dispensing aid further comprises means for displacing said means for engaging toward said opening, wherein:

said means for engaging comprises:

a crossbar for engaging a surface of at least one article in the row that is furthest from the opening, the crossbar being disposed between the surface and one of the plurality of walls;

said means for displacing comprises:

a pull bar having a first end that is attached to the crossbar; and a grip attached to second end of the pull bar opposite the first end.

4. A package, comprising:

a plurality of articles;

a carton enclosing said articles, said carton comprising:

a plurality of walls hingedly connected one to another;

an opening formed mat least one of said walls, said opening providing a dispenser for removing said articles from said carton;

a dispensing aid for displacing at least some of the articles toward said opening wherein said dispensing aid comprises means for engaging at least one of said articles, said means for engaging being displaceable toward said opening so as to displace said at teas some of said articles toward said opening wherein:

said plurality of articles are arranged in rows;

said opening is sufficiently large to expose articles in at least one of said rows for removal; and said means for engaging is further for engaging at least the articles in a furthest one of said rows from said opening, so that displacement of said means for engaging toward said opening displaces said furthest one of said rows and each intervening row toward said opening, wherein said means for engaging comprises a severance line disposed between adjacent ones of said rows of articles, said severance line being for detaching a portion of said means for engaging that engages said at least one of said rows that is exposed in said opening.

5. The package of claim 1, wherein said opening is sufficiently large to expose articles in at least one of said rows for removal.

6. The package of claim 4, wherein said severance line defines means for displacing the remainder of said means for engaging toward said opening.

7. The package of claim 1, wherein said means for engaging comprises a flexible section disposed between each adjacent pair of said rows of articles, said flexible section being for buffering the displacement of each successive one of said rows.

8. The package of claim 2, wherein said opening is sufficiently large to expose articles in at least one of said rows for removal.

9. The package of claim 3, wherein said opening is sufficiently large to expose articles in at least one of said rows for removal.

10. The package of claim 4, wherein said opening is sufficiently large to expose articles in at least one of said rows for removal.

* * * * *